US005698238A

United States Patent [19]

Fabbri

[11] Patent Number: 5,698,238

[45] Date of Patent: Dec. 16, 1997

[54] ROTARY TABLETTING MACHINE

[75] Inventor: Bruno Guido Fabbri, deceased, late of Bondeno, Italy, by Rovatti Fabbri Paola, heiress

[73] Assignee: I.M.A. Industria Macchine Automatiche S.p.A., Ozzano Emilia, Italy

[21] Appl. No.: 652,447

[22] PCT Filed: Dec. 9, 1994

[86] PCT No.: PCT/IT94/00207

§ 371 Date: Jun. 6, 1996

§ 102(e) Date: Jun. 6, 1996

[87] PCT Pub. No.: WO95/15846

PCT Pub. Date: Jun. 15, 1995

[30] Foreign Application Priority Data

Dec. 10, 1993 [IT] Italy ..... BO93A0493

[51] Int. Cl.[6] ..... B30B 11/08

[52] U.S. Cl. ..... 425/345; 425/353; 425/434; 425/DIG. 35; 425/435

[58] Field of Search ..... 425/344, 345, 425/348 R, 353, 354, 355, DIG. 35, 434, 435

[56] References Cited

U.S. PATENT DOCUMENTS

| | | | |
|---|---|---|---|
| 3,663,147 | 5/1972 | Maekawa et al. | 425/345 |
| 4,057,381 | 11/1977 | Korsch | 425/355 |
| 4,408,975 | 10/1983 | Hack | 425/353 |
| 4,943,227 | 7/1990 | Facchini | 425/345 |
| 5,211,964 | 5/1993 | Prytherch et al. | 425/345 |
| 5,350,548 | 9/1994 | Hinzpeter et al. | 425/345 |
| 5,462,427 | 10/1995 | Kramer | 425/345 |

FOREIGN PATENT DOCUMENTS

| | | |
|---|---|---|
| 0 473 458 | 3/1992 | European Pat. Off. . |
| 2 029 094 | 12/1970 | Germany . |
| 2 604 648 | 6/1977 | Germany . |
| 3 723 651 | 12/1987 | Germany . |
| G 93 06 785.2 | 7/1993 | Germany . |
| 785017 | 10/1957 | United Kingdom . |

*Primary Examiner*—Jay H. Woo
*Assistant Examiner*—Joseph Leyson
*Attorney, Agent, or Firm*—McAulay Fisher Nissen Goldberg & Kiel, LLP

[57] ABSTRACT

A rotary tabletting machine, for compressing powder or granular material, includes a rotating turret (3) supporting a ring-shaped member (5) in which openings (2) are made to be filled with the powder or granular material, with pairs of punches moved by driving means (10) which engage pairs of rollers (41) joined to the punches. The punches (20,30) have operative heads (21,31) adapted to compress the material inside the openings (2), and outer mobile heads (24,34), made of wear resistant material. The pairs of opposite punches (20,30) feature also, for each of the punches (20, 30), respective tightness seals (25,35).

4 Claims, 3 Drawing Sheets

N
0
P2
P2'
P3
C
F1
36.
38.
47.
52.30'
R1
P
P4
MP
F2
R2
90.30'
98.
105.30'
108.
110.30'
CP
P5
F3
1
2
3
4
5
6
10
20
21
22
24
25
26
30
31
32
34
35
36
40
41
60
61

ROTARY TABLETTING MACHINE

TECHNICAL FIELD

The present invention relates to the production of aggregates by compression of powdered or granular material.

In particular, the invention refers to a rotary tabletting machine that produces tablets by means of pairs of opposite punches driven by adjustable groove cams.

The subject tabletting machine carries out a new operative method of compression.

BACKGROUND ART

In the prior art there are known various rotary tabletting machines, which produce tablets from powdered material and which include only one turret driven to rotate around its axis.

The turret has means joined thereto for positioning and batching the material to be compressed, for compressing the material and for ejecting the tablets: see e.g. U.S. Pat. Nos. 2,989,781, 3,677,673, 3,999,922, 4,108,338, 4,943,227.

It is also known that the production of one tablet by a tabletting machine comprises a sequence of steps, that is, a step in which a suitable opening is filled with an appropriate quantity of material to be compressed, a step in which a prefixed volume of material is batched in the opening, optionally a precompression step, and then the subsequent compression of the material, with consequent formation of a tablet having determined thickness. Finally, a step occurs in which the tablet is ejected from the opening.

All the above mentioned steps take place during respective angular sections covered by the turret in a rotation round, and each working cycle can be carried out in a complete round or in a less extended rotation.

The pre-compression step has the purpose of reducing the problems resulting from the fact that the tablet, in its interior, keeps small quantities of air that can provoke microfractures, flaking or even explosion of the same tablet during ejection.

A tabletting machine that performs the precompression step is known from European Patent 0,204,266.

In some cases, a further improvement has been subsequently obtained by keeping the precompression load constant for a predetermined period of time, longer than normal precompression and compression time.

The load is usually kept constant by the action of compression means, constituted by pairs of opposite punches. The outer heads of the punches slide along stationary guides (sliding blocks) for a pre-established angular section of the rotation of the turret.

This, however, can cause irregular and early wear of the punch heads, resulting in the necessity of more frequent substitution thereof.

Alternative or complementary methods, like the addition of binding materials, have been applied in order to limit the above mentioned problems, but they have not managed to resolve them completely.

For example, in the machine illustrated by applicants U.S. Pat. No. 4,943,227, the material positioning and batching means include a plate, rigidly connected to the turret in its central part, and features a series of filling openings, made by as many through holes.

The through holes are angularly equispaced along the periphery of the plate and have their axes parallel to the axis of the turret.

For each opening there is a pair of opposite punches which are slidingly guided by respective through holes in the turret. The punches, and the opening are coaxial.

The operative heads of these punches are inserted in the related opening and the mutual distance between them is changed in such a way that it is possible to carry out, in synchrony with the turret rotation, a series of cyclical operative steps for the compression of powder material.

Each of the punches is driven by means of a respective roller that is fastened to a side of the punch and runs along a specially shaped groove cam, integral with the tabletting machine frame The feeding of the opening with the material to be compressed is made, in the example herein described, from a tank situated in the upper internal part of the turret, and takes place by means of channels made in the tank in correspondence with each opening.

The channels are fed continuously because of the centrifugal force due to the rotation of the same turret around its own axis.

The precompression step is carried out by a first reciprocal approaching of the operative heads of the pair of opposite punches as the result of the action of a pair of wheels on the respective outer heads.

These wheels are pivoted to the machine frame and idle on their hubs.

The compression step is carried out, after a momentary release of the punches, similarly to the precompression step, by the action of a second pair of wheels. German patent DE 3,723,651 discloses an automatic press for the manufacturing of tablets in the plastics, wax and candle production industry, consisting of a rotary table comprising reciprocated pistons and counter pistons, provided with pairs of rollers guided along respective grooved cams, to exert a precompression, and also comprising a pair of pressure rollers, to exert a final boosting pressure on tablets.

However, with the above described solutions, tablets with the current hardness and without the aforementioned defects are difficult to obtain, particularly with certain products, such as effervescent tablets or tablets containing big quantities of active ingredients.

SUMMARY OF THE INVENTION

The object of the present invention is to provide a rotary tabletting machine that can easily and efficiently carry out a compression method Another object of the present invention is to make easier adjustment and maintenance operations.

The aforementioned objects are achieved by providing a machine for compressing powdered or granular material, that includes:

- a rotary turret;
- a ring-shaped member fixed to the turret;
- a plurality of openings defined in the ring-shaped member by holes made therein with their axes parallel to the axis of the turret;
- a pair of punches for each opening, namely a lower punch and an upper punch, slidingly guided, in a direction parallel to the axis of the turret and along respective through holes made in the turret;
- at least a first pair of rollers, idling on respective first stationary hubs, these first rollers being arranged so as to strike and push the outer heads of the punches to perform a pre-compression of the material contained in the corresponding opening according to a load of pre-fixed value;

at least a second pair of rollers idling on respective second stationary hubs and situated downstream of the first pair of rollers, with reference to the rotation direction of the turret, so as to strike and push the outer heads of a respective pair of punches to perform a compression of the material contained in the corresponding opening according to a main load of value not less than the precompression value;

driving means formed by groove cams, designed to change the mutual distance between the operative heads of the lower and upper punches of every pair, during the performance of an operative cycle that occurs when a related opening moves along a predetermined arc having angular extension equal to at least one submultiple of round angle, the groove cams including six consecutive angle sections, respectively first, second, third, fourth, fifth, and sixth, with the third section situated immediately upstream of the symmetry plane of the first pair of rollers, with the fourth section placed immediately downstream of the plane, with the fifth section positioned immediately upstream of the symmetry plane of the second pair of rollers, and with the sixth section situated dowstream of the fifth section and upstream of the first section, to complete the round angle formed by the rotation of the turret;

at least one channel for each of the openings, aimed at feeding the material to be compressed, the channel being connected directly with a chamber containing the material and with the related opening;

pairs of rollers, orthogonally and rotatably fastened to opposite sides of the punches, near their related ends opposite to the respective operative heads, these last rollers being designed to run along and inside the groove cams.

BRIEF DESCRIPTION OF THE DRAWINGS

The characteristic features of the present invention are pointed out in the following with reference to the enclosed drawing, in which.

BEST MODE OF CARRYING OUT THE INVENTION

Figures 1, 1A, 4:
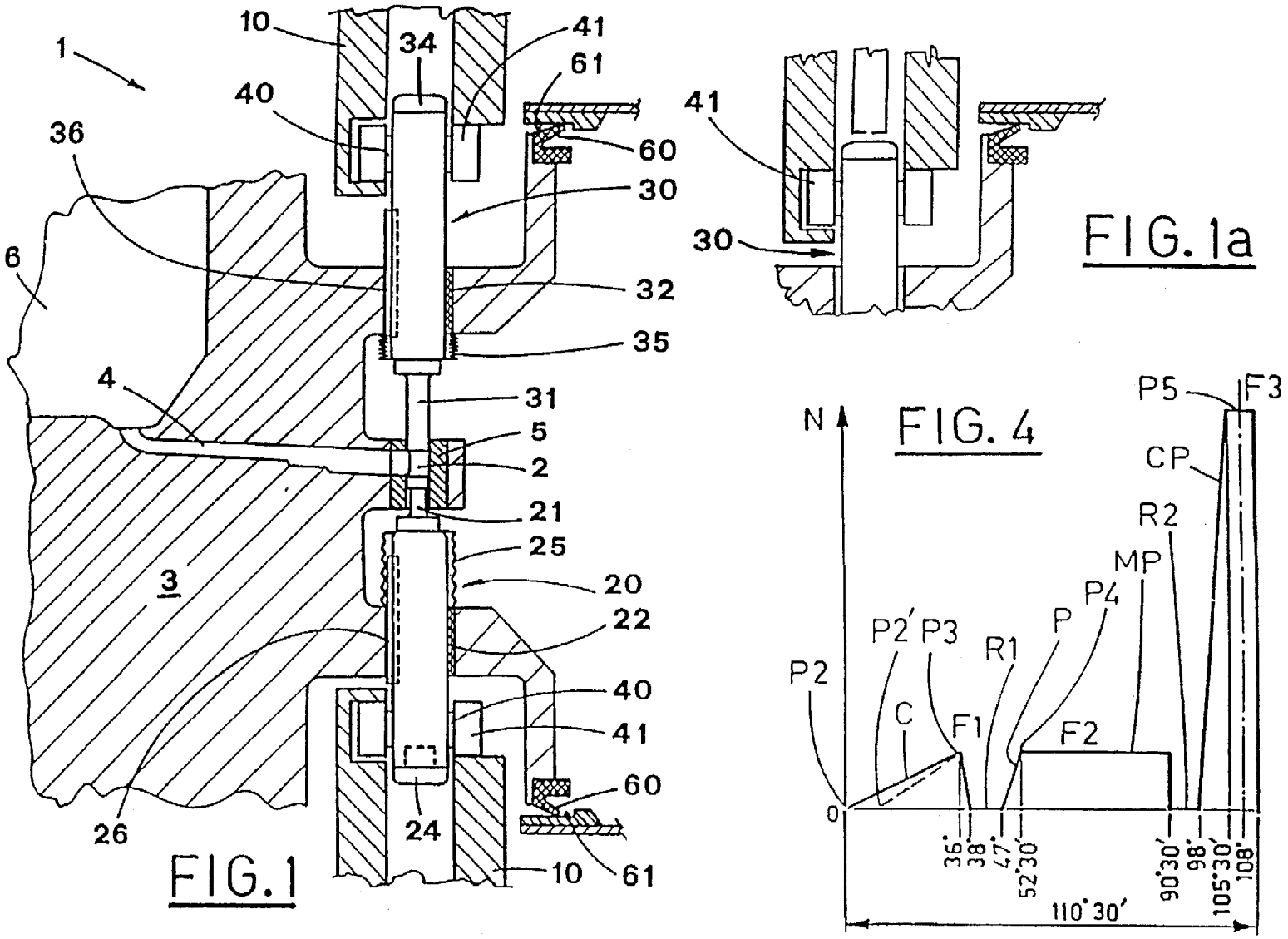
FIG. 1 shows a schematical side sectional view of a portion of a tabletting machine being the subject of the present invention.
FIG. 1*a* shows a constructive detail of the tabletting machine as it appears in an operative step other than the one shown figure.
FIG. 4 shows a load diagram resulting from consideration of the loads applied during operation of the machine.

With reference to FIGS. 1 and 1*a*, reference numeral 1 indicates a rotary tabletting machine for producing tablets, which machine includes a turret 3, rotatably carried by a supporting frame, not illustrated, and driven to rotate around its own axis by motor means, not illustrated, since they are known.

A ring-shaped member 5 is rigidly joined to the turret 3 in a position situated at an intermediate height level and near the periphery.

The ring-shaped member 5 features a series of openings 2, made by through holes whose axes are parallel to the axis of the turret 3. The openings 2 are equispaced and located along a circumference. This circumference and the turret 3 are coaxial.

For each opening 2 there are compressing means 20, 30 formed by two punches, a lower punch and an upper punch respectively, that are guided by relative through holes 22, 32 made in the turret 3, on opposite parts with respect to the opening 2. The punches and the opening 2 are coaxial.

Keys 26, 36, designed to prevent the punches 20, 30 from undesired rotations, are rigidly set into respective longitudinal splines made in the through holes 22,32, and engage with the same punches 20, 30.

Each of the punches 20, 30 is equipped, at the end close to the cited opening 2, with operative heads 21, 31, that are counterfacing.

The diameter of each head is inferior to the diameter of the opening 2, so that they can be inserted thereinside.

The end of each of punch 20, 30, opposite to the one provided with the respective operative head 21, 31, is covered by an outer head 24, 34, made of material harder than the body of the punch 20, 30, and that can be removed therefrom in case of wear.

Correspondent pins 40, extend perpendicular from opposite sides of the punches 20, 30, near the outer heads 24, 34, and support idling pairs of rollers 41, with each roller arranged opposite with respect to the other one.

Moreover, each punch 20, 30 has, in its part included between the operative heads 21, 31 and the through holes 22, 32 in which the same punches slide, a concertina collapsible tightness seal 25, 35.

The aforementioned pairs of rollers 41 are located in correspondence with driving means 10, formed by groove cams, integral with the supporting frame of the tabletting machine. The groove cams 10 and the turret 3 are coaxial.

The groove cams 10 are subdivided into six consecutive angular sections $Z_1$, $Z_2$, $Z_3$, $Z_4$, $Z_5$, and $Z_6$, respectively first, second, third, fourth, fifth, and sixth, which form a complete turn through which each opening 2 is brought.

The first $Z_1$, second $Z_2$, and fourth $Z_4$ angular sections drive all the rollers 41, while the third $Z_3$ and fifth $Z_5$ angular sections do not engage the rollers 41 related to the upper punches 30, but only those rollers 41 related to the lower punches 20, keeping the latters in the position reached after having left the previous angular section.

In the remaining sixth angular section $Z_6$ (not completely illustrated) making up a round angle, that is next to the fifth angular section $Z_5$ and immediately precedent to the first one $Z_1$, the groove cams 10 drive the rollers 41 during the well known tablet ejecting operation, after which the initial conditions of the compression cycle are restored.

The above mentioned sections from first $Z_1$ to fifth $Z_5$ can be partially displaced in directions parallel to the motion of the punches 20, 30 (see FIG. 3), so as to set different initial volumes of the opening 2 as well as different final volumes of the same opening 2, while the compression operation is performed.

In this way it is possible to set the batched quantity of material to be compressed in the opening 2 and the final dimension of the tablet.

Moreover, the position of the exit part of the first section $Z_1$ with respect to the inlet part of the second section $Z_2$ can be changed continuously, such that the second section $Z_2$ is initially engaged by the pairs of rollers 41 in a position $P_2'$ that is as far from the inlet part of the same second angular section, as the second angular section $Z_2$ is displaced.

The period-of time during which the second angular section drives the rollers is varied accordingly.

Since the pairs of rollers 41 are arranged symmetrically at opposed sides of the punches 20, 30 and engage at the same time the groove cams 10, the axial loads acting on the same punches 20, 30 do not cause any tilting moment at any time on the punches but urges only in a direction parallel to the same punches, thus reducing the friction action made by the punches on the through holes 22, 32.

The turret 3 has sliding sealing rims 60 located close to the housings of the punches 20, 30, and movable along with the turret 3.

The sealing rims 60 slide on the outer surfaces 61 that belong to the supporting frame of the tabletting machine 1, with the aim of shielding the punches from the outside.

In correspondence with the terminal parts of the third $Z_3$ and fifth $Z_5$ angular sections, the outer heads 24, 34, of the punches 20, 30 go into engagement with, in the following sequence, a first pair of rollers 50 and a second pair of rollers 51.

The pairs of rollers are set idling on respective hubs fitted to the supporting frame of the tabletting machine 1.

The combined action of the groove cams 10 on the rollers 41 and of the pairs of rollers 50, 51 on the outer heads 24, 34 causes the axial displacement of the punches 20, 30, thus changing the mutual distance between the operative heads 21, 31 moment by moment.

In the turret 3, there is a chamber 6, in which the material to be compressed is gathered. The bottom of the chamber 6 is slightly higher than the ring-like member 5.

The chamber 6 is also connected with all the openings 2 by radial channels 4 in such a way that a slant is created between the bottom of the chamber 6 and each opening 2.

The chamber 6 is supplied with material to be compressed by feeding means, not illustrated, since they are known.

Figure 2:
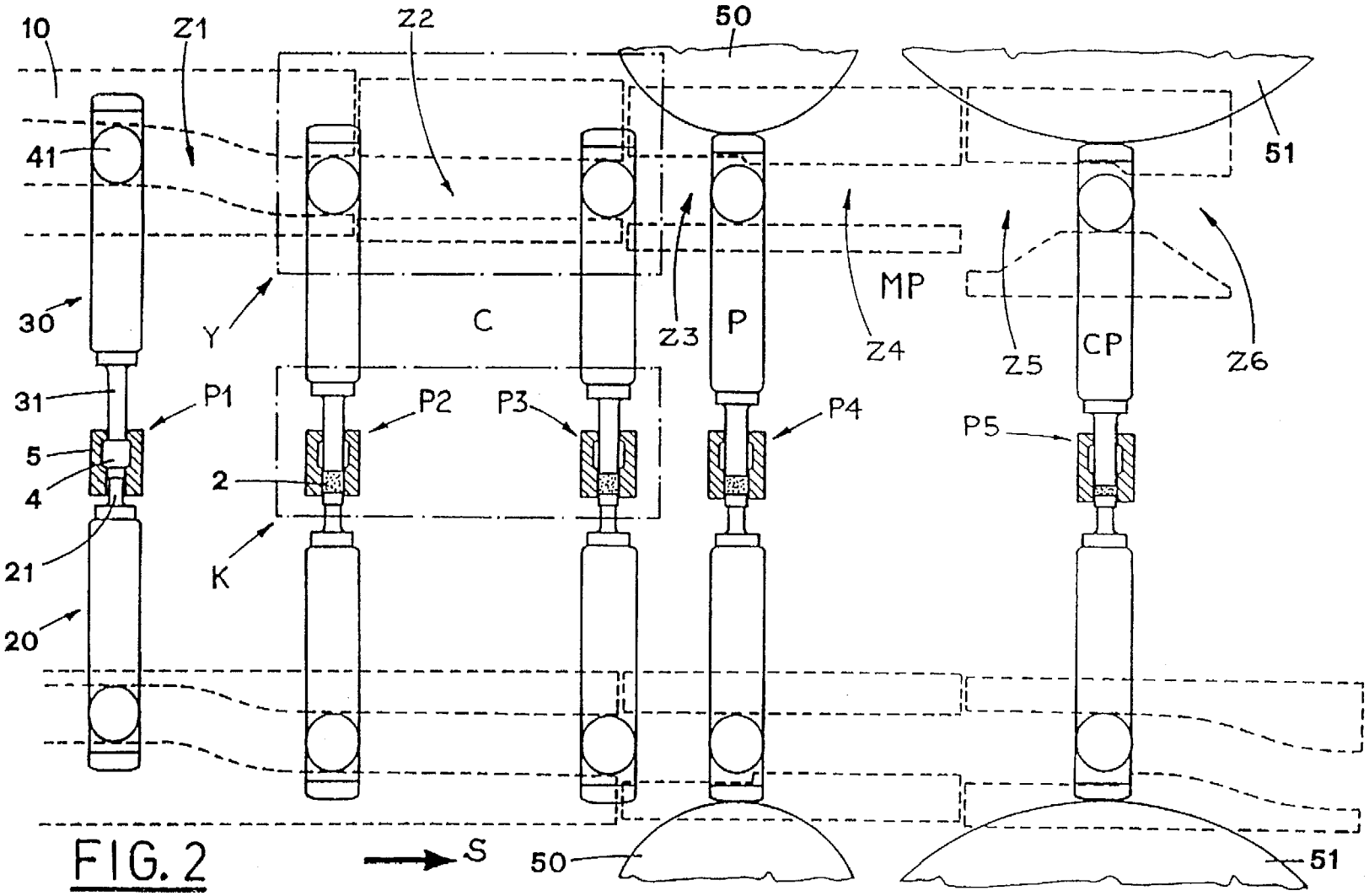
FIG. 2 shows schematically, as an example, the sequence of steps in an operative cycle during which a tablet is produced, this sequence being carried out by the machine of the present invention.
Figure 3:
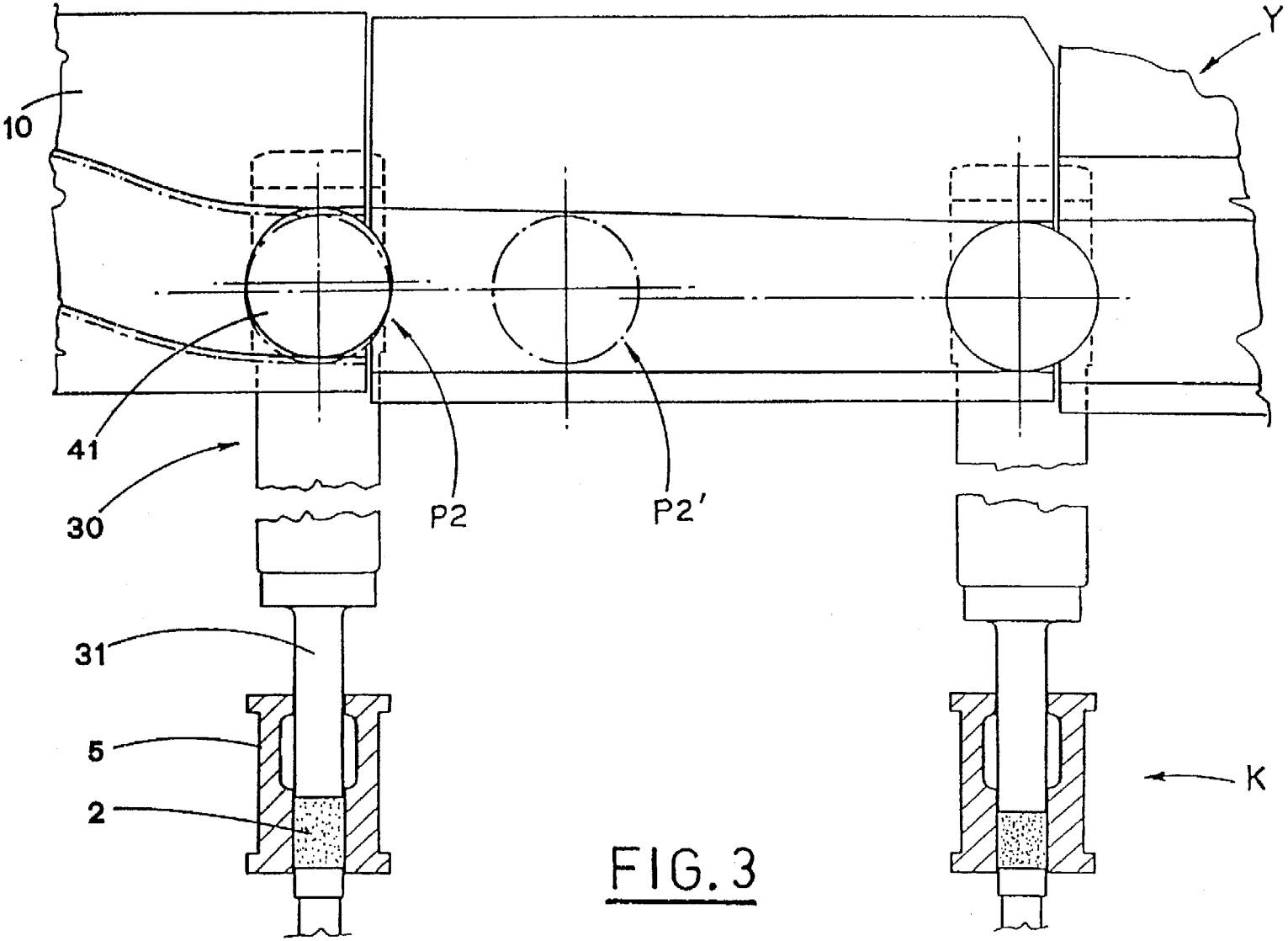
FIG. 3 shows enlarged views of particulars Y and K taken from FIG. 2.

The operative steps carried out by the above described tabletting machine 1 are illustrated in the following with reference to FIGS. 2, 3, and 4.

The rotation, in the pre-established direction S, of the turret 3, that brings the series of the punches 20, 30 and the ring-like member 5, that is the related openings 2, through the various sections of the groove cams 10, results in the punches 20, 30 and related openings 2 running cyclically through angular sections whose respective value can be established conventionally beginning from an angular position in which the mutual position of the operative heads 21, 31 allows to feed, via the feeding channel 4, the opening 2 with the material to be compressed.

The feeding of the cited opening 2 is made easier in every moment by the combined action of gravity and centrifugal force produced by the rotation of the turret 3.

The centrifugal force urges the material that fills the part of the opening 2 delimited by the opposite heads 21, 31, as soon as the position of the operative head 31 permits the channel 4 to communicate with the same opening 2.

In this step, corresponding to a first characteristic position $P_1$ of the operative heads 21, 31, the rollers 41 are driven by the first section $Z_1$ of the cams 10, and the cited heads 21, 31 are synchronically translated downwards, until the opening 2 and the dose of material contained therein is isolated from the feeding channel 4, and until the same heads are brought to a second characteristic position $P_2$, that can be conventionally defined as relative to an angular position of 0° (see applicant's U.S. Pat. No. 4,943,227).

The second position $P_2$ coincides with the beginning of a step C when the material is compacted, in which, e.g. through an arc of 36° the path of the cams 10 in the second angular section $Z_2$, is slightly inclined towards the opening 2 and the head 31 gradually comes closer to the opposite head 21, in such a way that a progressive load is applied to the material until a first predetermined load value F1 and a first reduction of the volume of the same material is obtained.

The load F1 is fully applied when the heads 21, 31 are in a third characteristic position $P_3$.

A first release step R1 begins just downstream of the position $P_3$. In the release step R1 the pairs of rollers 41 are in the third angular section $Z_3$ of the cams and therefore, the pair of rollers 41 related to the upper punch 30 is disengaged from the cams, while the pair of rollers 41 relative to the lower punch 20 is held in place by the cam 10 and the punch 20 is kept in the previously reached position.

The angular extension of this step in the example is of 11° Downstream of the latter position, due to the rotation of the turret 3, a step P is carried out in which the material undergoes a precompression for an angular amplitude of 5°30', until the characteristic position $P_4$ is reached.

In this step the outer heads 24, 34 are stricken by the first pair of rollers 50 and consequently, the heads 21, 31 come nearer to each other until a second predetermined load value F2, e.g. equal with the value F1 obtained in the compacting step C, is obtained.

Immediately downstream of the above mentioned position $P_4$, the pairs of rollers 41 come in the fourth angular section $Z_4$ of the groove cams 10, beginning the activation of a step MP in which the precompression is maintained.

In this step the pairs of rollers 41 are again in engagement with the cams 10, so as to keep, during the whole step MP, the previously reached value of load F2 acting on the material.

The angular amplitude in the example is 38°.

After having passed the above mentioned fourth angular section $Z_4$, the pairs of rollers 41 run along the fifth angular section $Z_5$ of the cams 10.

In this section the pair of rollers 41 relative to the upper punch 30 is again disengaged from the cams 10, allowing the operative head 31 to activate another step R2 in which the load applied to the material is released, e.g. through an angular extension of 7°30'.

The pair of rollers 41 related to the lower punch 20 are driven by the respective cam 10 and the punch 20 is kept in the previously, reached position.

Subsequently, the second pair of rollers 51 act on the external heads 24, 34 causing the beginning of a main compression step CP and making the operative heads 21, 31 to come closer to each other until they reach a third load value F3, not lower than the value F2 previously reached in the precompression step P.

Activation of this step CP provokes punches 20, 30 and the related openings 2 to move to the characteristic position $P_5$ that coincides with the maximum load position.

The angular extension of the above mentioned step CP is, for example, of 50°30'.

The operative production cycle of one tablet ends with a tablet ejection step, carried out in a known way, in which the said tablet is first carried in a position external to the ring-like member 5, and then it is taken over by known ejecting means, while the punches 20, 30 are brought back to the position $P_1$ for beginning of a new productive cycle.

A tabletting machine as the one described above, carries out a method that, with the introduction of the aforementioned compacting C and precompression maintenance MP steps into the operative cycle, permits the material grains to approach reciprocally with a more gradual rate, and therefore their interpenetration is improved.

In this way also the efficiency of air expulsion from the inside of the material is improved, and consequently the tablets are more solid and without imperfections even in the most difficult cases.

The above mentioned improvements are obtained without reducing the rotation speed of the turret 3 and consequently, without affecting negatively the productivity of the tabletting machine.

Moreover, the introduction of the compressing C and precompression maintenance MP steps allows the tabletting machine 1 to obtain a product having the same quality, even if a load F3, applied during the main compression step CP, has a lower value than the load applied without the first two steps.

This allows to reduce the dimensions of the machine 1, that results in considerable cost saving.

The first $Z_1$ and the second $Z_2$ sections of the groove cams 10 are mutually movable and can be situated in such a way that the pairs of rollers 41 joined to the upper punch 30 go in engagement with the second angular section $Z_2$ in a position $P_2'$ that is as far from the inlet of the same second angular section, as the second angular section $Z_2$ is displaced.

This allows optimizing the duration of the compacting step C in accordance with the characteristic features of every single material.

With the punches 20, 30, made in the above described way, the compacting and precompressing maintenance loads are applied thereon by the groove cams 10 more efficiently and the maintenance operations are shorter in duration and made after longer intervals of time, since only the mobile external heads 24, 34 and not the whole punches are to be replaced.

During the compacting C and precompression maintenance MP steps, both rollers of every pair 41 engage the relative groove cams 10, as shown in FIG. 1a, so that the load on the material to be compressed is balanced and symmetrical.

The action of the groove cams 10 on the rollers 41 is contrasted by the elastic reaction of the same material.

Obviously, the invention in question has been described, with reference to the enclosed drawings, as a mere, not limitative example, therefore, it is understood that all the possible changes and variants suggested by either the practice or activation or use of the machine are included in the scope as defined by the following claims.

It is claimed:

1. Machine for compressing powdered or granular material, comprising:

a turret (3) rotating around its own axis in a preestablished direction (S);

a ring-shaped member (5) fixed to the turret (3);

a plurality of openings (2) defined in the ring-shaped member by holes made therein with their axes parallel to the axis of the turret (3);

a pair of punches (20, 30), provided for each one of the openings (2), each pair having a lower punch and an upper punch, slidingly guided, in a direction parallel to the axis of the turret (3) and along respective through holes (22, 23) made in the turret, each punch having an operative head (21, 31) for compressing material within the corresponding opening, and each punch having an outer head (24, 34);

at least a first pair of rollers (50), idling on respective first stationary hubs, the first pair of rollers being arranged so as to strike and push the outer heads (24, 34) of the punches (20, 30) to perform a pre-compression of the material contained in the corresponding opening (2) according to a load of a pre-fixed value (F2);

at least a second pair of rollers (51) idling on respective second stationary hubs and situated downstream of the first pair of rollers (50), with reference to the rotation direction (S) of the turret (3), so as to strike and push the outer heads (23, 24) of a respective pair of said punches (20, 30) to perform a compression of the material contained in the corresponding opening (2) according to a main load of value (F3) not less than the precompression value (F2);

driving means (10) formed by groove cams, designed to change the mutual distance between the operative heads (21, 31) of the punches, respectively the lower punch (20) and the upper punch (30) of every pair, during the performance of an operative cycle that occurs when a related opening (2) moves along a pre-determined arc having an angular amplitude equal to at least one sub-multiple of a round angle, the groove cams (10) including six consecutive angular sections ($Z_1$, $Z_2$, $Z_3$, $Z_4$, $Z_5$, $Z_6$), respectively first, second, third, fourth, fifth, and sixth sections, with the third section ($Z_3$) situated immediately upstream of a symmetry plane of the first pair of rollers (50), with the fourth section ($Z_4$) placed immediately downstream of the plane, with the fifth section ($Z_5$) positioned immediately upstream of a symmetry plane of the second pair of rollers (51) and with the sixth section ($Z_6$), situated downstream of the fifth section ($Z_5$) and upstream of the first section ($Z_1$), to complete the round angle formed by the rotation of the turret (3);

at least one channel (4) for each of the openings (2), for feeding the material to be compressed, the channel being connected directly with a chamber (6) containing the material and with the related opening (2);

for each of the punches (20, 30), at least a respective pair of punch rollers (41), orthogonally and rotatably fastened to opposite sides of the punches (20, 30), near their ends opposite to the respective operative heads, the punch rollers movable along and inside the groove cams (10);

and wherein the second angular section ($Z_2$)is shaped to engage the pairs of rollers (41) of a related pair of the punches (20, 30) to cause a gradual compacting of the material contained in the opening (2) corresponding to the pair of punches (20, 30) according to a load rising from zero up to a predetermined value (F1);

the third section ($Z_3$) receives, with a clearance, the pair of punch rollers (41) joined to the upper punch (3) of the pair of punches (20, 30), to set the load again to zero, and to hold the pair of punch rollers (41) joined to the lower punch (20) so as to maintain the lower punch in the position reached at an exit of the second angular section ($Z_2$);

the fourth section ($Z_4$) engages the pairs of punch rollers (41), when the first pair of rollers (50) strike the outer heads of the pair of punches (20, 30), so as to maintain the pre-compression load acting on the material contained in the opening;

and the fifth angular section ($Z_5$)receives with a clearance the pair of punch rollers (41) relative to the upper punch (30) entering a corresponding opening (2), so as to set again to zero the load acting on the material contained in the opening (2), and to drive the pair of punch rollers (41) joined to the lower punch (20) so as to keep the same lower punch (20) in the position reached at the exit of the fourth angular section ($Z_4$).

2. Machine according to claim 1, wherein the second angular section ($Z_2$) is vertically mobile, with gradual motion, with reference to the adjacent angular sections ($Z_1$, $Z_3$), so that the pairs of punche rollers (41) joined to the upper punch (30) go in engagement with the second angular section ($Z_2$) in a position ($P_2$') that is as far from the inlet of the same second angular section, as the second angular section ($Z_2$) is displaced.

3. Machine according to claim 1, wherein the punches (20,30) are provided with respective tightness seals (25,35), separated from one another, situated near the operative heads (21,31) of each punch (20,30) to protect a portion thereof sliding in the through holes (22,23).

4. Machine according to claim 3, wherein the tightness seals (25,35) are collapsible concertina seals.

* * * * *